United States Patent [19]

Nickels

[11] Patent Number: 5,074,064

[45] Date of Patent: Dec. 24, 1991

[54] SNOW SHOVEL

[76] Inventor: James G. Nickels, 5808 Calhoun, Dearborn, Mich. 48126

[21] Appl. No.: 538,779

[22] Filed: Jun. 15, 1990

[51] Int. Cl.[5] ..... E01H 5/02

[52] U.S. Cl. ..... 37/265; 37/285

[58] Field of Search ..... 37/117.5, 130, 265, 37/285, 126 AB, 126 AE; 294/54.5, 55, 59, 50

[56] References Cited

U.S. PATENT DOCUMENTS

| | | | |
|---|---|---|---|
| 781,543 | 1/1905 | McClay | 37/130 |
| 1,006,985 | 10/1911 | Smith | 37/130 |
| 1,200,196 | 10/1916 | Huberty | 37/130 |
| 2,463,559 | 3/1949 | Reischl et al. | 37/126 AB |
| 3,310,891 | 3/1967 | Sachaczenski | 37/130 |
| 3,469,326 | 9/1969 | Malickson | 37/265 |
| 3,475,838 | 11/1969 | Hagen et al. | 37/130 |
| 3,861,730 | 1/1975 | Ringo | 294/55 X |
| 4,224,751 | 9/1980 | Schoemann et al. | 37/265 |
| 4,316,627 | 2/1982 | Solypa | 294/55 X |

*Primary Examiner*—Dennis L. Taylor
*Assistant Examiner*—J. Russell McBee
*Attorney, Agent, or Firm*—Charles W. Chandler

[57] ABSTRACT

A snow shovel that includes a forwardly opening hood supported on front and rear wheels for movement into a layer of snow on the ground surface. The bottom walls of the shovel is formed by a snow ejection plate that is swingably mounted for movement in a vertical arc from a prone position to an upright position. Snow deposited on the upper face of the plate is forcibly ejected from the shovel when the plate is swung to its upright position.

10 Claims, 2 Drawing Sheets

SNOW SHOVEL

BACKGROUND AND SUMMARY OF THE INVENTION

This invention relates to a manually-operated snow shovel having a self-contained ejection plate. In a preferred form of the invention, the shovel comprises a forwardly-opening hood having a blade at its front end; and elongated handle is attached to the hood for pushing it into a layer of snow on a driveway, sidewalk or other surface that needs to be cleared of snow.

The hood is equipped with two front ground wheels and two rear ground wheels, such that the blade at the front end of the hood is maintained in near proximity to the ground surface as the hood is moved into the snow layer. Forward motion of the hood causes the blade to move underneath the snow layer, whereby a quantity of snow is relocated within the hood.

The snow is deposited onto a snow ejection plate that extends rearwardly from the blade to the hood rear wall. This snow ejection plate is hingedly connected to the blade for swinging motion in a vertical arc. While the shovel is moving into a snow layer to capture snow, the ejection plate is in a prone (lowered) position. After a quantity of snow has been deposited onto the ejection plate, the shovel is backed away from the snow layer and then moved to a location where it is desired to discharge the snow captured by the hood. A cable-type lifter means is connected to the ejection plate to swing it upwardly to an essentially upright position.

Upward swinging motion of the ejection plate causes the snow to be thrown upwardly and forwardly through the mouth of the hood, thereby emptying the shovel so that it can be used to capture a new load of snow. An advantage of the shovel is that it does not have to be lifted from the ground surface; the ground wheels can remain on the ground surface at all times. The snow ejection plate ejects the snow from the hood without any requirement for lifting the hood away from the ground surface.

I have found that the performance of the ejection plate is improved when a stop means is arranged in the path of the ejection plate as it is being moved toward its upright position. The plate is stopped suddenly (abruptly) such that the snow on the ejection plate is thrown off the plate by inertia action. Slush that otherwise might stick to the ejection plate is effectively dislodged from the plate surface.

My shovel is in some respects similar to a snow shovel shown in U.S. Pat. No. 4,224,751 issued to G. Schoemann, et al. The Schoemann patent shows a shovel formed partly by a flexible plastic sheet having a generally C-shaped cross-sectional configuration. A cable is connected to the sheet for exerting an upwardly pulling action thereon, sufficient to eject snow from the sheet front surface. It appears, however, that the flexible sheet enjoys only a slight forward motion, such that only a relatively small snow ejection force is developed. I believe my proposed shovel has an improved performance compared to the shovel shown in the Schoemann patent.

THE DRAWINGS

Figure 4:
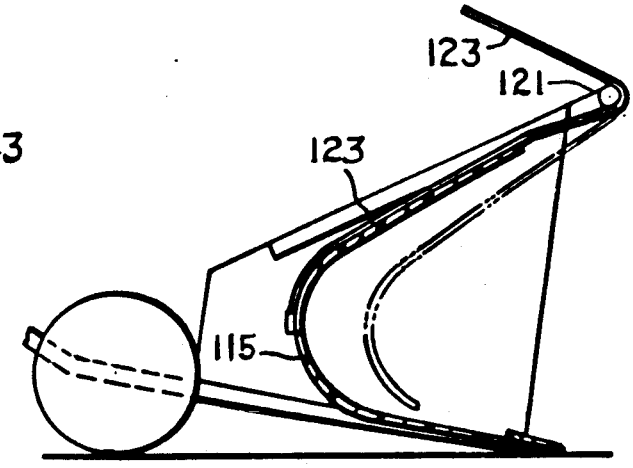
FIG. 4 PRIOR ART

FIG. 4 is a cross-sectional view taken through a prior art snow shovel disclosed in U.S. Pat. No. 4,224,751.

DESCRIPTION OF A PREFERRED EMBODIMENT OF THE INVENTION

Figure 1:
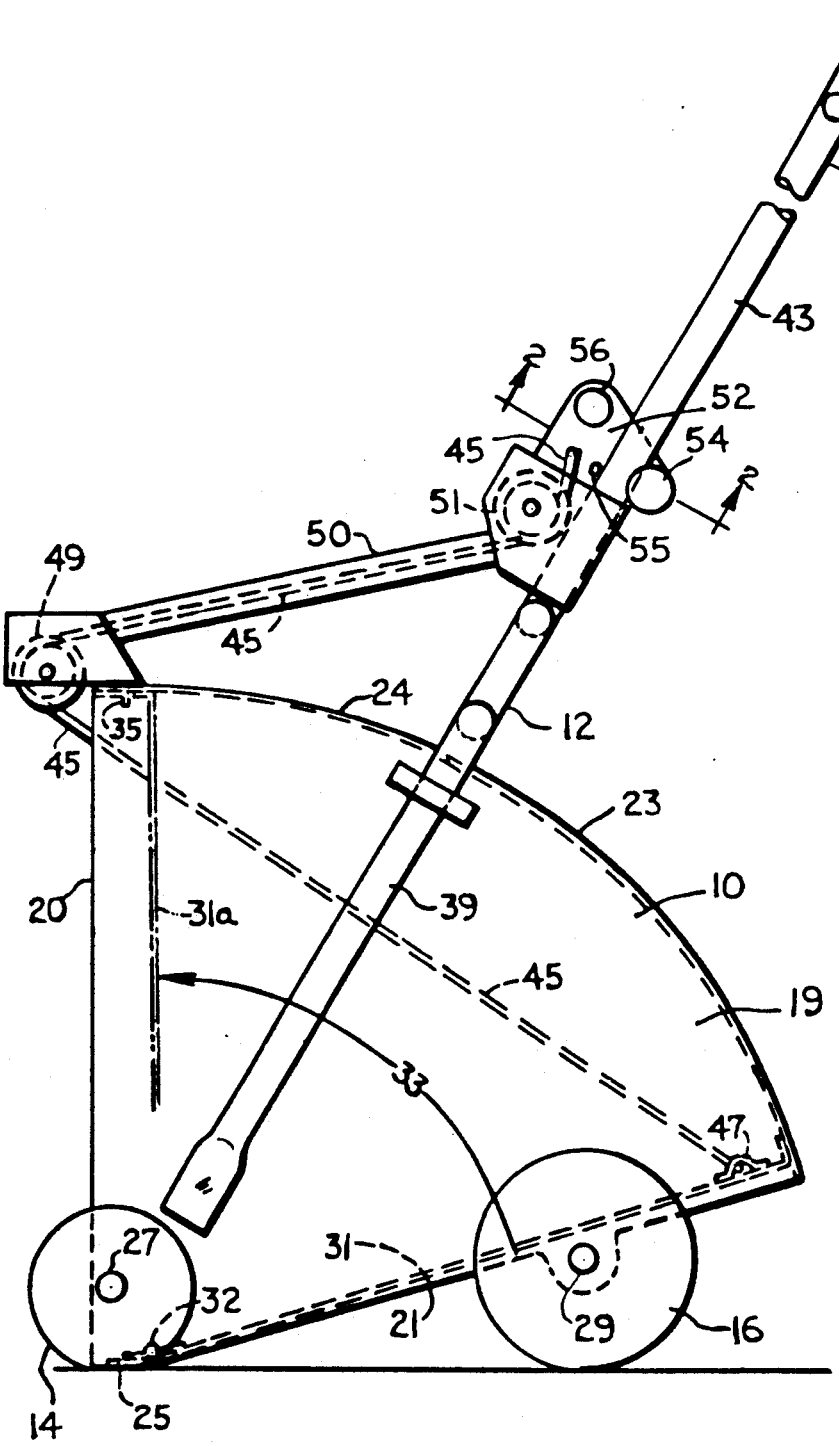
FIG. 1 is a side elevational view of a snow shovel embodying my invention.
Figure 2:
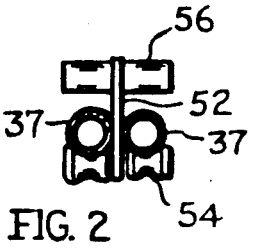
FIG. 2 is a fragmentary cross-sectional view taken on line 2—2 in FIG. 1.
Figure 3:
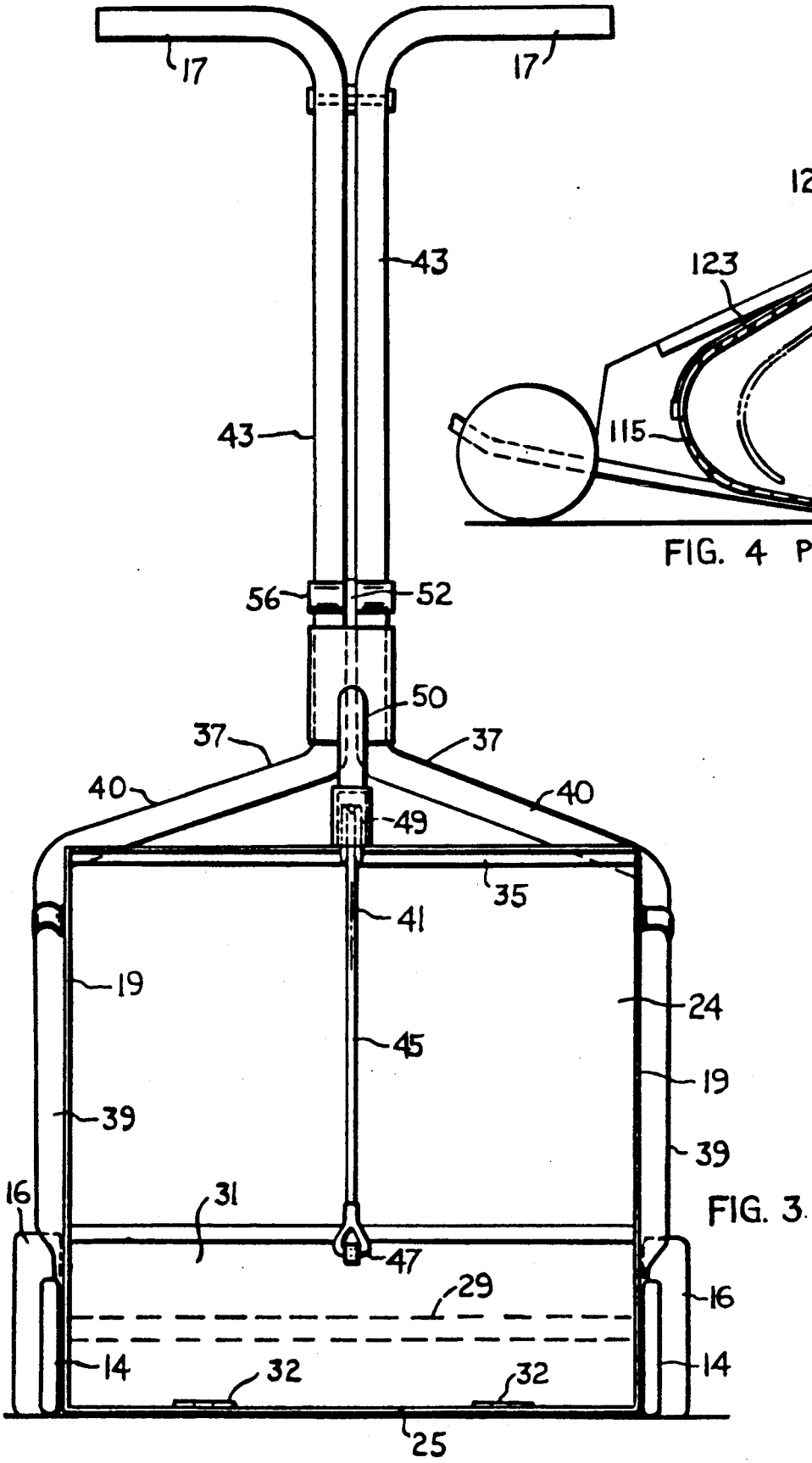
FIG. 3 is a front elevational view of the FIG. 1 snow shovel.

FIGS. 1 through 3 show a snow shovel that includes a hood 10 attached to an elongated handle 12. The hood is supported on a ground surface by two front ground wheels 14 and two rear ground wheels 16. Handle 12 includes two hand grips 17 (FIG. 3) that can be manually grasped by the person operating the shovel. The person will stand behind the shovel, i.e., to the right of the shovel in FIG. 1. He can move the shovel forwardly (to the left in FIG. 1) or rearwardly, depending on whether he is loading new snow into shovel or repositioning the shovel for ejecting the snow or aligning the shovel relative to a new snow mass.

Hood 10 is formed in part by two similar side walls 19 spaced apart as shown in FIG. 3. Each side wall is a flat upstanding metal sheet having a segment shape, as seen in FIG. 1. Each side wall has a generally vertical front edge 20, a lower edge 21, and an arcuate rear edge 23. A sheet metal rear wall 24 is suitably secured to the arcuate rear edges of the two side walls.

The vertical front edges 20 of the hood side walls 19 are spaced apart and unconnected so as to form a snow entrance mouth for the hood. However, a transversely extending blade 25 extends between the hood side walls in near proximity to their front edges 20.

Each front wheel 14 has a fixed stub shaft (axle) 27 suitably attached to the associated hood side wall 19. Each wheel shaft 27 is located substantially directly above blade 25 (as seen in FIG. 1), such that the blade is maintained in close proximity to the ground surface when the shovel is in motion.

The two rear wheels 16 are mounted on a transversely extending shaft 29 that spans the space beneath the hood side walls. Shaft 29 may be a dead axle having fixed connections to side walls 19, or the shaft can be a live shaft extending through bearings attached to the hood side walls.

A flat rectangular snow ejection plate 31 extends between blade 25 and the arcuate rear wall 24. The rear edge of plate 31 is in close proximity to arcuate wall 24. Also, the side edges of plate 31 are in close proximity to the inner surfaces of hood side walls 19. Therefore, the plate will retain any snow captured by the hood as the shovel is moved forwardly (leftwardly in FIG. 1) into a snow layer.

Horizontal axis hinges 32 connect the front edge of plate 31 to blade 25, such that the plate can be swung upwardly and forwardly, as designated by numeral 33 in FIG. 1. A stop means 35 is affixed to the hood in the upward path of plate 31, such that the plate can swing forwardly only to the upright position designated by numeral 31*a* in FIG. 1. The plate comes to an abrupt stop, while any snow on the plate is thrown off the plate through the mouth of the hood. Arcuate hood wall 24 is located on a circular arc that is centered on the axis of hinges 32. Therefore, the rear edge of plate 31 is maintained in near proximity to wall 24 as the plate is moved from its prone position to its upright position. Snow is prevented from passing through the relatively slight clearance space at the rear edge of plate 31. The plate acts as a swingable piston during the snow ejection process.

Handle 12 is shown as being comprised of two similarly-configured tubular members 37. Each tubular member includes a lower section 39 extending along one of the hood side walls 19, a transversely extending section 40 extending toward the hood centerline 41, and an upper section 43 extending in near proximity to the hood centerline. Hand grips 17 extend transversely from the upper sections 43 of the handle. The two tubular members 37 are firmly attached to hood 10 and to each other, such that the defined handle 12 and hood 10 become a rigid unitary structure.

A cable-type lifter means is provided for swinging snow ejection plate 31 from its prone position to its upright position 31*a*. The lifter means comprises a flexible cable (rope, cord or braided wire) 45. The lower end of the cable is anchored to plate 31 as at 47. The cable passes around a grooved pulley 49, through a tube 50, and then around a second grooved pulley 51. Each pulley 49 or 51 is preferably enclosed (at least partially) within a small housing affixed to hood wall 24 or to handle 12. The aim is to protect the pulley shafts from the elements, and to prevent snow or ice from becoming clogged in the pulley grooves. Tube 50 acts as a shield to prevent any build-up of snow or ice on the cable surface.

The upper end of cable 45 is attached to a plate 52 that extends between tubular sections 43 of handle 12. Rollers 54 and a transverse pin 55 are carried on the plate 52 for loosely (floatably) positioning the plate on handle 12. Hand grips 56 extend from plate 52 in spaced relation to handle 12. The structural arrangement is such that an upward pulling motion on hand grips 56 will be effective to swing the snow ejection plate 31 from its prone position to its upright position. When hand grips 56 are released the weight of plate 31 causes it to return to its prone position by gravity action. As an alternative, hinges 32 could have torsion springs incorporated therein to provide a return force for plate 31.

In use of the illustrated shovel, the shovel will be manually advanced into a snow layer by movement of the shovel in a right-to-left direction (FIG. 1). Blade 25 will move underneath the snow layer, such that a mass of snow is deposited onto plate 31. Depending on the snow density and the strength of the person operating the shovel, the snow can partially or completely fill the hood interior space.

When the hood is loaded with snow, the shovel is pulled back and rolled to a location where it is feasible to discharge the snow from hood 10. A manual pull on hand grips 56 swings plate 31 upwardly and forwardly around the hinge 32 axis, thereby ejecting the snow out of the hood interior space. When plate 31 strikes stop means 35 the plate is abruptly brought to a halt. However, the momentum built up by the swinging plate causes the snow to be thrown forcibly out through the mouth of the hood.

As seen in FIG. 1, plate 31 is inclined slightly in a front-to-rear direction when it is in its prone position. The inclination angle may be about fifteen degrees. This slight inclination somewhat reduces the manual force required to operate plate 31. The inclination of plate 31 slightly reduces the volumetric capacity of the hood, but not to any great extent. In its upright position, 31*a* the snow ejection plate is approximately normal to the ground surface. The stroke of the ejection plate (arc 33) is about seventy-five degrees.

It will be seen from FIG. 3 that front wheels 14 are relatively narrow, whereas rear wheels 16 are relatively wide. Both sets of wheels can include rubber tires for traction purposes. However, the primary tractive force is provided by the relatively wide rear wheels 16 (due to their larger ground contact area). Front wheels 14 are narrow in order to better penetrate the snow layer without generating excessive resistance to full penetration of the shovel into the snow. Typically, wheels 14 can be on the order of one-half inch wide.

FIG. 4 depicts a prior art shovel that is shown in somewhat greater detail in U.S. Pat. No. 4,224,751. The shovel includes a curved wall 115 formed of a flexible plastic sheet material. A cable 123 extends from an anchorage on wall 115 along the rear surface of the curved wall and around a circular tube 121. FIG. 4 shows in dashed lines the position of wall 115 after the cable has been pulled to a point where the upper edge of wall 115 is in near proximity to tube 121.

It will be seen that wall 115 has a relatively short stroke and a relatively small forward displacement during the snow ejecting process. It is believed that wall 115 would not be able to eject any appreciable quantity of snow out of the shovel. The effective capacity of the shovel would be quite limited.

The shovel shown in FIGS. 1 through 3 is believed to be an improvement on the prior art shovel shown in FIG. 4. The drawings depict one particular form that the invention can take. However, the invention can be practiced in other forms and configurations.

I claim:

1. A snow shovel comprising:

a hood that includes two upstanding side walls, a snow-penetration blade extending between said side walls at ground level, and an arcuate rear wall extending between said side walls spaced remotely away from said blade;

two ground wheels located outboard from said side walls for supporting the hood at an elevation wherein the blade is maintained in close proximity to the ground surface as it penetrates a layer of snow on the ground surface; a snow ejection plate located within the hood, said snow ejection plate having a front edge in near proximity to the blade and a rear edge in near proximity to the hood rear wall;

a horizontal axis hinge means connecting said snow ejection plate to the blade whereby the snow ejection plate can swing in a vertical arc between a lowered prone position and a raised upright position;

a manually-operated lifter means connected to said ejection plate for moving the plate from its lowered prone position to its raised upright position;

said arcuate rear wall being centered on the hinge means axis so that the rear edge of the snow ejection plate is maintained in near proximity to the hood rear wall as it moves from its prone position to its upright position; and a stop means carried by said hood in the path of the snow ejection plate so that the plate stops suddenly when it reaches its raised upright position, thereby permitting snow to be thrown from the plate by inertia action.

2. The snow shovel of claim 1, wherein the snow ejection plate has a stroke of approximately seventy-five degrees measured around the hinge means axis.

3. The snow shovel of claim 1 and further comprising two additional ground wheels located outboard from said side walls at an appreciable distance behind the hinge means axis.

4. The snow shovel of claim 3, wherein the first mentioned ground wheels are rotatably mounted on a common axis located substantially directly above the snow penetration blade.

5. The snow shovel of claim 1, and further comprising an elongated manually-engageable handle means extending upwardly from the hood for moving the hood over the ground surface; said lifter means including a first pulley mounted on the hood rear wall substantially directly above the blade, a second pulley mounted on the handle means above the hood rear wall, a flexible cable means having one end thereof attached to the snow ejection plate near its rear edge, and a hand grip attached to the other end of the cable means whereby an upward manual pulling motion on the handgrip causes the snow ejection plate to move from its prone position to its upright position.

6. The snow shovel of claim 1, wherein said snow ejection plate is slightly inclined in a front-to-rear direction when the plate is in its prone position.

7. The snow shovel of claim 6, wherein the front-to-rear inclination of the snow ejection plate is approximately fifteen degrees.

8. A snow shovel comprising:

a hood that includes two upstanding segment-shaped side walls;

each side wall having an essentially vertical front edge, a lower edge extending rearwardly from said front edge, and an arcuate rear edge extending upwardly and forwardly from the lower edge to the upper edge; said hood further including an arcuate rear wall interconnecting said side walls, said rear wall following the arcuate rear edges of the side walls to form a snow-reception chamber having a snow entrance mouth defined by the front edges of the hood side walls;

a flat snow ejection plate hingedly connected to the hood at a point near the intersection between the front edges and the lower edges of the hood side walls, said snow ejection plate having a rear edge in near proximately to said arcuate rear wall, said snow ejection plate being swingable between a prone position extending along the lower edges of the hood side walls and an upright position extending essentially parallel to the vertical edges of the hood side walls;

said arcuate rear wall being centered on the hinge means axis so that the rear edge of the snow ejection plate is maintained in near proximity to the hood rear wall as it moves from its prone position to its upright position;

two front ground wheels connected to the hood side walls near the plane of the snow entrance mouth, and two rear ground wheels connected to the hood a substantial distance behind the front wheels; and the front wheels being relatively narrow, and the rear wheels being relatively wide, whereby the narrow wheels are enabled to penetrate a snow layer, and the wide wheels have relatively good tractive engagement on a snow-cleared surface.

9. The snow shovel of claim 8, and further comprising a stop means located within the hood near the plane of the snow entrance mouth; said stop means located in the path of the snow ejection plate as said plate swings upwardly to its upright position, whereby the plate stops suddenly so that snow is thrown from the plate through the snow entrance mouth by inertia action.

10. The snow shovel of claim 9, and further comprising a manually-operable lifter means for swinging the snow ejection plate from its prone position to its upright position; said lifter means including a pulley mounted on the hood rear wall near the plane of the snow entrance mouth, and a flexible cable extending around said pulley into the hood, one end of said cable being connected to the snow ejection plate near its rear edge, whereby upward cable motion around the pulley swings the snow ejection plate toward its upright position.

* * * * *